United States Patent [19]

Ono et al.

[11] Patent Number: 4,646,928

[45] Date of Patent: Mar. 3, 1987

[54] FOLDING CONTAINER

[75] Inventors: Tatsuo Ono; Kikuzo Kuramoto, both of Funabashi, Japan

[73] Assignee: Nisso Sangyo Co., Ltd., Japan

[21] Appl. No.: 690,141

[22] Filed: Jan. 10, 1985

[51] Int. Cl.[4] ..... B65D 7/26; B65J 1/02

[52] U.S. Cl. ..... 220/6; 220/1.5; 220/7

[58] Field of Search ..... 220/6, 1.5, 7

[56] References Cited

U.S. PATENT DOCUMENTS

| | | | |
|---|---|---|---|
| 3,073,466 | 1/1963 | Greer et al. | 220/1.5 |
| 3,195,506 | 7/1965 | Beard | 220/6 |
| 3,618,803 | 11/1971 | Dobberkau et al. | 220/6 |
| 3,645,596 | 2/1972 | Russell-French | 220/1.5 |
| 3,796,342 | 3/1974 | Sanders et al. | 220/6 |
| 4,162,737 | 7/1979 | Clive-Smith | 220/6 |
| 4,214,669 | 7/1980 | McQuiston | 220/6 |

*Primary Examiner*—Joseph Man-Fu Moy
*Attorney, Agent, or Firm*—McGlew and Tuttle

[57] ABSTRACT

Container to be used to transport goods or materials from one place to another remote place using a large truck, etc.

The front side plate and back side plate are folded into two and the side faceplates are made as shutters which can move up and down.

It is formed into a box when it contains goods or materials and when it does not contain them, the shutters are housed in the upper part and the front side plate and back side plate are folded into two.

2 Claims, 15 Drawing Figures

FOLDING CONTAINER

BACKGROUND OF THE INVENTION

This invention concerns a folding container to transport goods and materials.

When goods or materials are transported from one place to a faraway place using the rolling stock, large trucks, ships, etc., they are put in large cubic containers and transported safely to the destination.

Since these containers are cubic, they can be neatly arranged side by side on the vehicle without leaving wasteful dead space, and in the container many goods or materials can also be neatly arranged, and therefore, they can be safely transported without being damaged.

But if, for example, no import cargoes are available from a foreign country to which export cargoes were sent by ship, or if no order for land transport back form a faraway place to which materials were sent, the used containers must be brought back empty.

In such cases, there was an economic disadvantage because the voluminous containers occupy a large space on the ship, truck or vehicle and the freight costs extra high.

Therefore, the objective of this invention is to provide a container which can be formed into a box when in use and can be folded compact when not in use.

Another objective of this invention is to provide a container which can be easily and correctly folded and assembled.

Still another objective of this invention is to provide a container which has a simple configuration.

In order to achieve the above objectives, the container of this invention consists of front and back sides which can be folded into two respectively and 2 side plates adjoining to the front and back plates which is made as a shutter which is movable vertically.

DESCRIPTION OF THE PREFERRED EMBODIMENT

Figure 1:
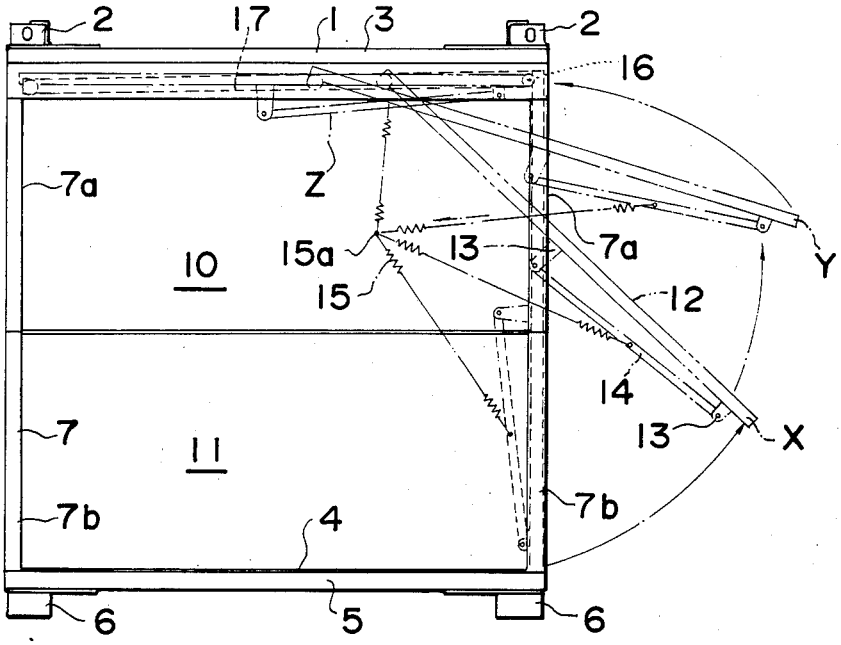
FIG. 1 is a front view of the container of an embodiment of this invention.

The following will explain the embodiments of this invention referring to the drawings.

Figure 2:
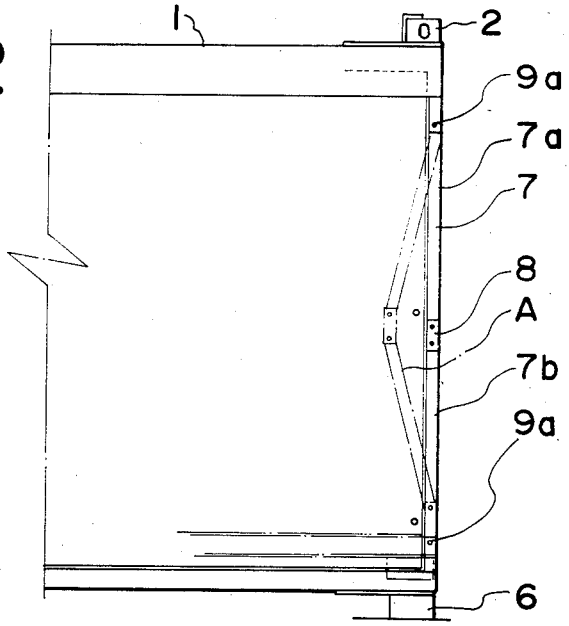
FIG. 2 is a side view of the container, with portions broken away.
Figure 3:
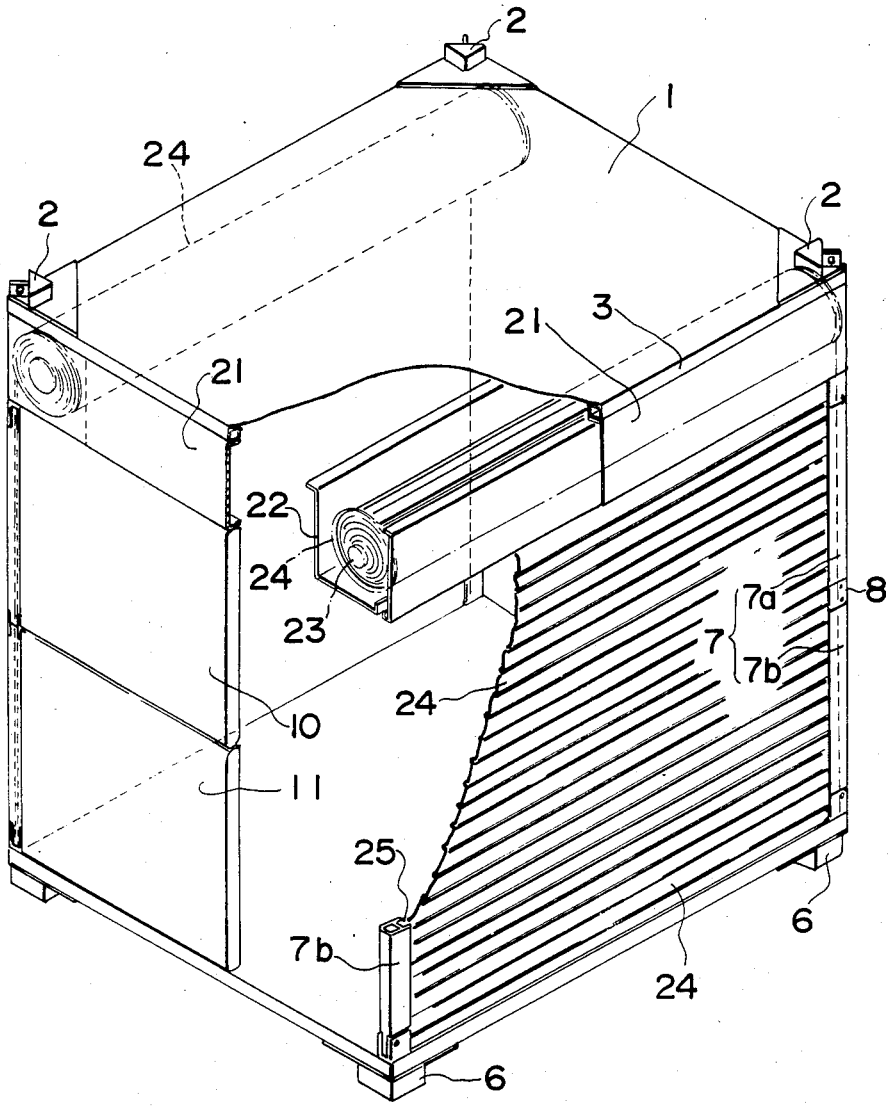
FIG. 3 is a partially cutaway view in perspective of the container of another embodiment of this invention.

FIG. 1 and FIG. 2 are front view to show one embodiment and a side view of a portion of it respectively. (1) is the top board of this container and is made of iron plate, etc., and it is provided with lifting lugs (2) for crane lifting, etc. at the 4 corners. To the 4 sides of this top board (1), reinforcing frames (3), for example, made of square pipe, are welded. (4) is the bottom board of the container which is also provided with the same reinforcing frames (5) at the 4 sides. Foot members (6) are welded to the underside of the bottom board at the 4 corners. Between the upper and lower reinforcing frames (3) and (5), 2 struts (7) each are provided on the front side and back side of the container. The strut 7 consists of U strut members *(7a)* and *(7b)* which are pivotally linked with each other at one end by means of the hinge member (8) so that they can be bent forward and backward and at the other end they are also pivotally linked to the brackets (9) on the reinforcing frames (3) and (5), sides by means of the pins *(9a)* so that forward and backward turning can be achieved. The strut members *(7a)* at left and right are connected with each other by means of the cover plate 10 and the strut members *(7b)* at left and right by means of the cover plate 11, and these cover plates 10 and 11 located at front and back form the front plate and back plate of the container respectively.

(12) is right faceplate to be used as a shutter which is provided inside with 2 projected brackets (13) at both ends to which a long links (14) are attached, and between the approximate center of the link (14) and the pins *(15a)* provided on the cover plates 10 of the front faceplate and back faceplate, coil springs (15) are provided fixed at both ends. The right faceplate (12) is provided with guide rollers (16) at the upper end side which can move on the guide rails (17) provided on the reinforcing frames (3) at the front and back. The said coil springs (15) always pull inward the right faceplate (12).

The left faceplate (not illustrated) adopts the same installation structure as the said right faceplate (12) and can be housed in the same manner when the container is folded. It can be installed as one plate or other type of shutter in such a way that it can be housed under the top board (1) or above the bottom board (4).

In the container thus made up, the lower part of the right faceplate (12) is raised against the force of the coil springs (15) and moved in the arrow direction to X by moving the guide rollers (16) toward left on the guide rails (17). When it is further moved to reach the position Y, the coil springs (15) is expanded to its maximum and then the distance between the supporting points of the coil springs (15) is shortened and the contracting force of the coil spring (15) makes it smooth to open the right faceplate (12). When the lower end of the right faceplate (12) gets near to the reinforcing frame 3, it is housed within the thickness of the guide rail (17) and retained in the Z position.

The left faceplate can be raised along the guide rails and housed in the upper part in the same way as the right faceplate or can be turned at a hinge shaft to superpose on the top board (1).

Then the cover plates (10) and (11) forming the front faceplate and back faceplate are pushed inward at the hinge member (8) and folded turning at the pins (a) and finally the top board (1) and the right faceplate (12) under it are folded on the bottom board (4). As explained above, the container can be easily folded and the occupying space after folded becomes small, thus making the transport easier. When it is used as a container, the assembly is quite easily done by reversely operating the cover plates (10) and (11) and right faceplate (12) and left faceplate.

FIGS. 3 to 8 show another embodiment of this invention. The same components bear the same symbols as those in FIGS. 1 and 2. (21) are supporting frame plates installed at 4 sides under the reinforcing frames (3) and the supporting frame plates at left and right sides are provided with shutter cases (22) in which the take-up shaft 23 is installed to take up the shutter (24). The shutter (24) is pulled in a fixed direction by the force of springs (not illustrated) installed to the take-up shaft (23) and the balance between the spring force and the weight of the shutter (24) allows a smooth manual operation of the shutter.

Figure 6:
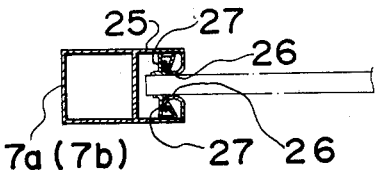
FIG. 6 is an enlarged cross-sectional plan view of the guide rail.

On the mutually facing sides of the strut members (7*a*) and (7*b*) located at front and back, U-shaped guide rails (25) are provided in a monolithic way or separately and the shutter (24) smoothly moves within the guide rails (25). The guide rail (25) has the opening edge bent inward as shown in FIG. 6 in which a packing (27) is engaged and by moving the shutter (24) in contact with the packing (27), the airtightness of the container can be improved.

Figure 4:
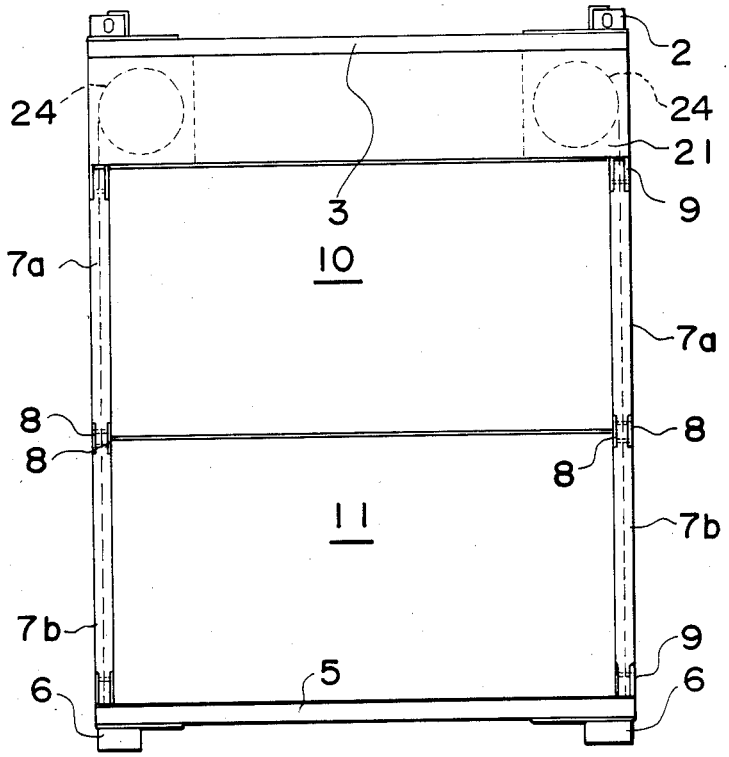
FIG. 4 is a front view of the container in FIG. 3.
Figure 7:
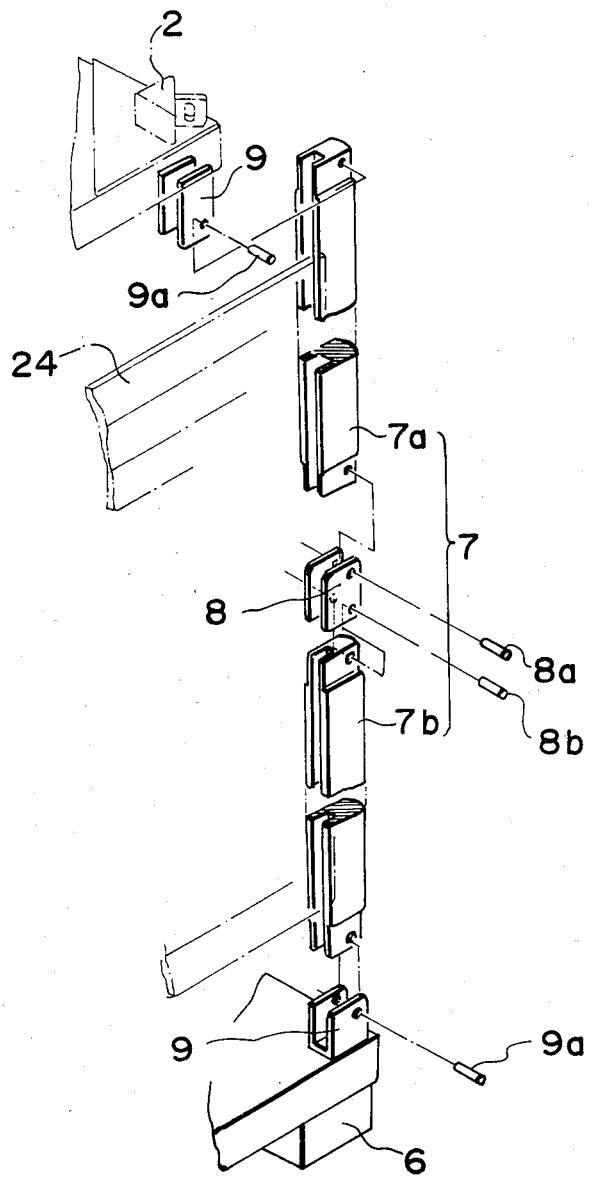
FIG. 7 is an enlarged exploded perspective view to show the hinge linkage of the strut member.
Figure 8:
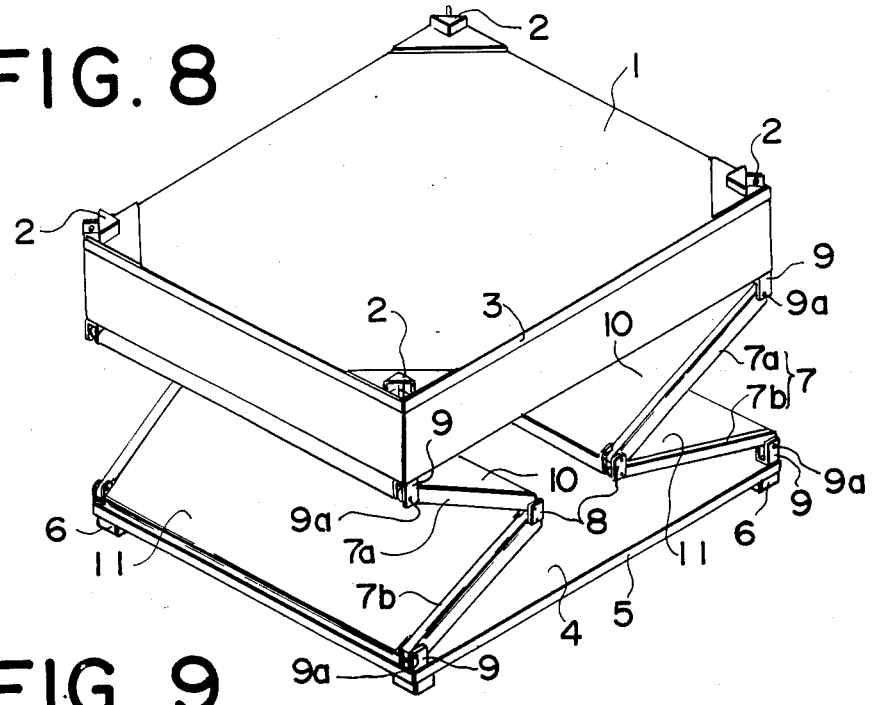
FIG. 8 is a perspective view to show the container being folded.

FIGS. 4, 7 and 8 show in detail the hinge linkage of the strut members (7*a*) and (7*b*). According to them, the strut members (7*a*) and (7*b*) are pivotally supported at one end by means of the pins (9*a*) which are inserted in the brackets (9) and at the other end by means of the pins (8*a*) and (8*b*) which are inserted in the hinge member (8) consisting of 2 plates facing each other.

Figure 5:
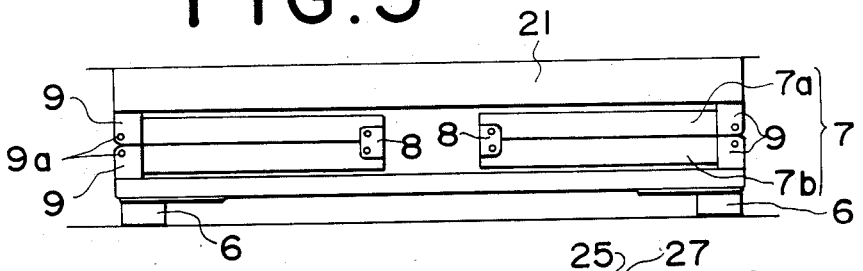
FIG. 5 is a side view of the folded container of FIG. 3.

When the container is folded, the shutter (24) is manually raised along the guide rails (25) and wound up on the take-up shaft (23) and then the strut members (7*a*) and (7*b*) are bent in a dogleg at the ping (8*a*) and (8*b*) and the top board (1) is lowered. If the folding operation is further continued, the cover plated (10) and (11) at both front and back, top board (1) and bottom board (5) are piled up as shown in FIG. 5, thus making the volume of the container smaller.

Figure 9:
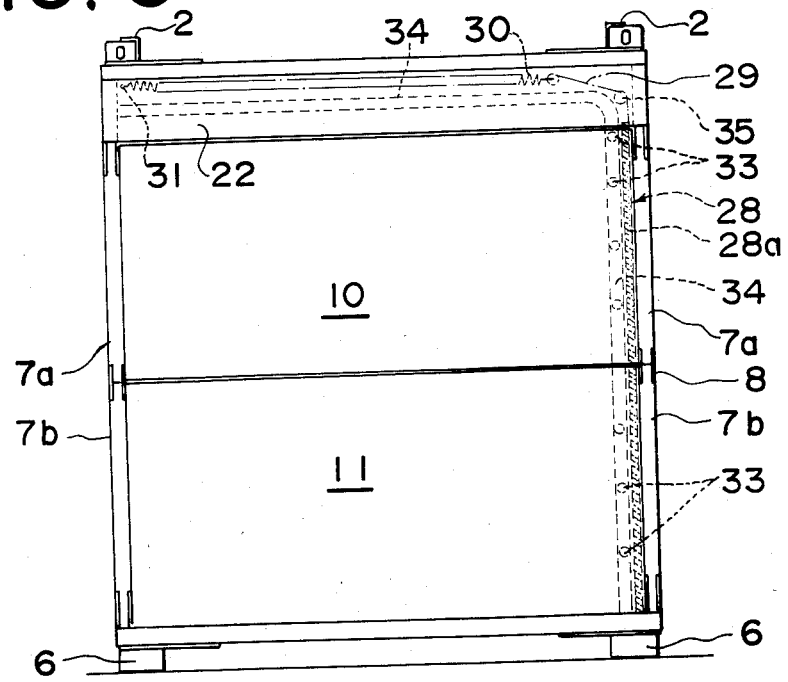
FIG. 9 is a front view of the container of still another embodiment of this invention.
Figure 10:
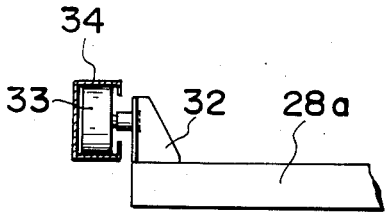
FIG. 10 is an enlarged cross-sectional plan view of the guide rail of the container.
Figure 11:
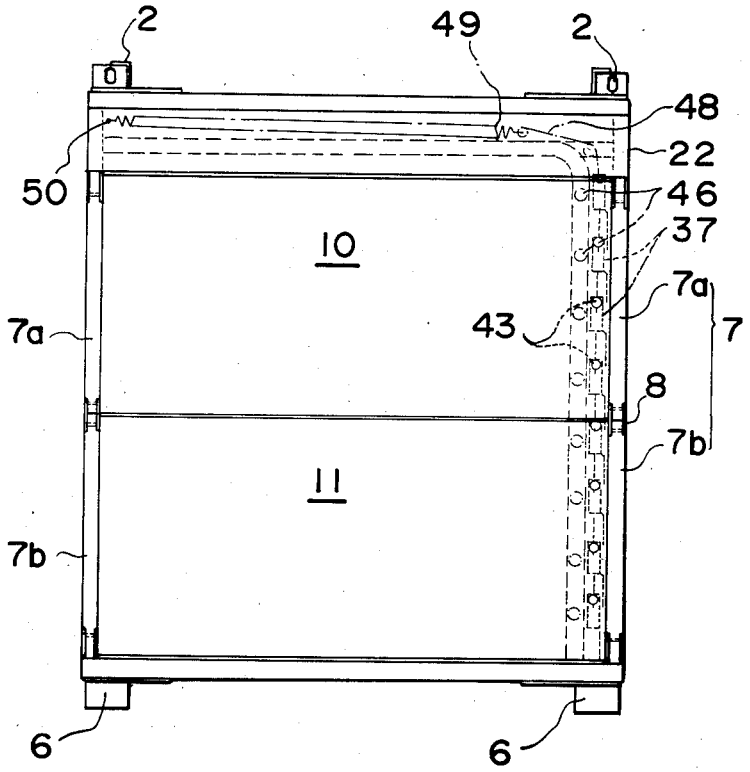
FIG. 11 is a front view of the container of still another embodiment of this invention.

FIGS. 9 and 10 show still another embodiment of this invention. This has the same folding structure of the cover plates (10) and (11) as that of the abovementioned embodiment except the moving structure of the shutter. That is, (28) is a shutter consisting of multiple plates (28*a*) with a little wide width arranged vertically and these plates (28*a*) are connected with one another in a rotating way and to the upper end of the shutter (28) one end of the coil spring (30) is connected via the hanging line (29) and the other end of the coil spring (30) is hooked to the pin (31) in the shutter case (22) and the shutter (28) is always pulled into the shutter case (22) by the force of the coil spring. For this reason, when the shutter (28) is lowered to form the both side walls of the container, the hook provided at the lower end of the shutter (28) is hooked to the fixing member fixed to the reinforcing frame (5). To both ends of the plates (28*a*) to form the shutter (28), guide rollers (33) are attached via brackets (32) as shown in FIG. 10 and the guide rollers (33) roll smoothly within the guide rails (34) provided monolithic along the strut members (7*a*) and (7*b*) and shutter case (22) to move the flexible shutter (28) up and down smoothly. (35) is a guide wheel for the hanging line. The container of this embodiment is folded in the same way as explained above.

Figure 12:
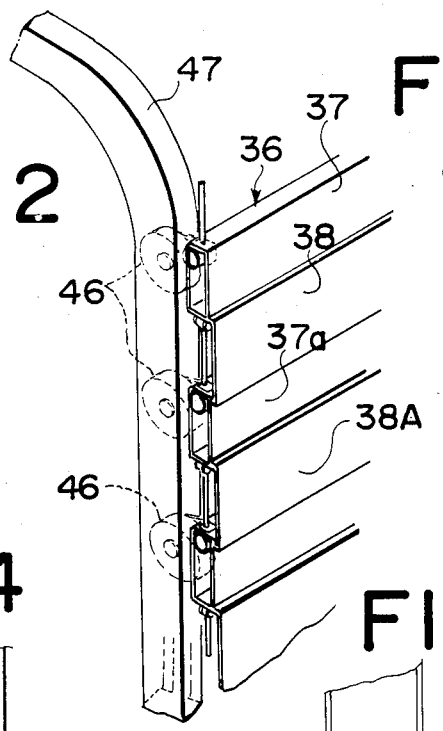
FIG. 12 is a perspective view to show some enlarged portions of the container in FIG. 11.
Figure 13:
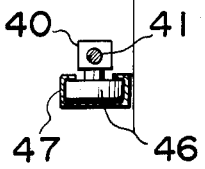
FIG. 13 is an enlarged cross-sectional plan view of the guide rail of the container.
Figure 14:
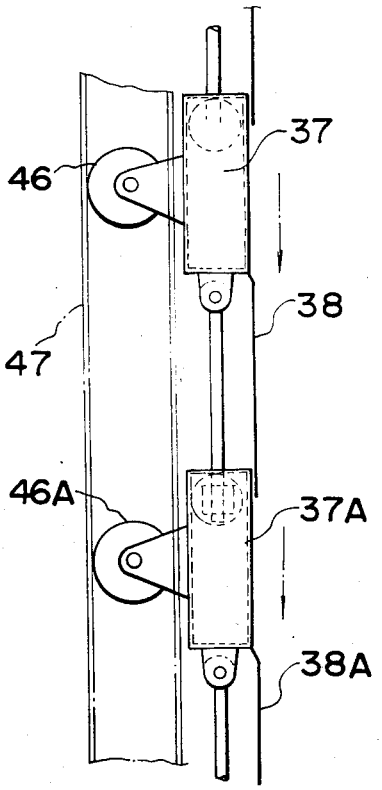
FIGS. 14 and 15 are partially enlarged front view to show the shutter movement.

FIGS. 11 to 15 show still another embodiment of this invention. This embodiment has the same folding structure of the cover plates (10) and (11) as the aforementioned embodiment but has a different moving structure of the shutter. In these figures (36) is a shutter consisting of multiple plates (39) connected together which consist of rectangular case (37) and plate (38) suspended from the case (37), and to the bracket (40) projected down from the case (37) one end of the connecting rod (41) is pivoted by a pin (42) and the other end of the connecting rod (41) is located within the lower adjoining other case (37A) and does not come out of the case (37A) because it has a Tappet (43) and the connecting rod (41) can freely slide within the case (37). (38A) is a plate connected to the other case (37A), 40A is a bracket, and 41A is a connecting rod. (44) and (44A) are brackets projected inward from the cases (37) and (37A) inserted in the brackets (44) and (44A) are provided with guide rollers (46) and (46A) which rotate. These guide rollers (46) and (46A) roll in the approximately L-shaped guide rails (47) attached in a separable way to the strut members (7*a*) and (7*b*), as shown in FIG. 12. To the lowest case (37) one end of the coil spring (49) is fixed via the hanging line (48) and the other end of the coil spring is fixed to pin (50) in the shutter case (22). The coil spring (49) is always pulling the shutter (36) into the shutter case (22), and therefore, when the shutter (36) is lowered to form the side wall of the container, the hook provided at the lower end of the shutter (36) is hooked to a fixing member fixed to the reinforcing frame (5). The shutter can be used even if the spring (49) does not exist.

Figure 15:
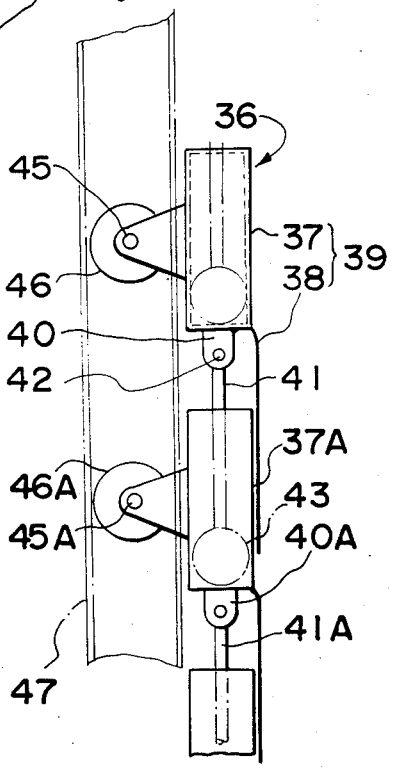

In such a moving structure of the shutter, the shutter (36) is pulled into the shutter case (22) by the contracting force of the coil spring (49) in the same way as for the aforementioned embodiment, i.e. when the aforementioned hook is removed from the fixing member, the lowest case (37) is pulled up by the contracting force of the coil spring (49) and the higher cases (37) are sequentially raised as shown in FIG. 15 in such a way that the higher case is superposed on the adjoining lower case and are housed in the shutter case (22). Subsequently by bending the strut members (7*a*) and (7*b*) into a dogleg at the hinge member (8) and lowering the top board, the volume of the container can be made smaller and the occupying space can be reduced during transportation as explained in FIG. 5.

As explained in detail above, this invention realizes a practicable container with simple structure and reduced failure which can be easily an properly folded and assembled by folding 2 counterpart side faceplates into two and making the other 2 counterpart side faceplates adjoining the said 2 side faceplates as shutters which can move up and down.

What is claimed is:

1. A foldable container comprising, a top wall having a rectangular upper reinforcing frame forming a shutter case for receiving a shutter, a bottom wall having a rectangular lower frame, four vertical struts connected between respective corners of said upper and lower reinforcing frames, each strut comprising an upper strut member pivotally mounted to one corner of said upper reinforcing frame and a lower strut member pivotally mounted to one corner of said lower reinforcing frame, said upper and lower strut members of each strut being pivotally mounted to each other, two of said struts being on one side of said container and two of said struts being on opposite side of said container, said upper and lower strut members of each strut being pivotally mounted to each other and to said upper and lower reinforcing frames for pivoting inwardly away from said one and opposite sides of said container and toward each other for folding said container, an upper cover plate fixed between said upper strut members of said struts on each side of said container, a lower cover plate fixed between said lower strut members on each side of said container, said upper and lower cover plates covering said sides of said container when said container is unfolded, said container having a front opening when unfolded between one strut on one side of said container and one strut on the opposite side of said container, a flexible shutter moveable over said opening to close said opening with said container unfolded, a guide rail formed monolithically with each of said upper and lower strut members of said struts which bound said front opening, each guide rail having a guide groove facing said front opening, said shutter having opposite edges respectively facing said struts bounding said front opening, a plurality of guide rollers mounted for rotation to said opposite edges of said shutter, said guide rollers being rollably engaged in said guide rails for vertical movement of said shutter, and spring means connected between said upper reinforcing frame and said shutter for urging said shutter upwardly into said shutter case.

2. A foldable container according to claim 1, including a hinge member pivotably mounted between said upper and lower strut members of each strut.

* * * * *